US006127035A

United States Patent [19]

Carter et al.

[11] Patent Number: 6,127,035

[45] Date of Patent: Oct. 3, 2000

[54] LOW DIELECTRIC COMPOSITE FIBER AND FABRIC

[76] Inventors: H. Landis Carter, 100 Ticonderoga Dr., Greer, S.C. 29650; Frank Christopher Malik, 402 Spring Meadow Rd., Simpsonville, S.C. 29680

[21] Appl. No.: 09/204,510

[22] Filed: Dec. 3, 1998

[51] Int. Cl.[7] ..... B32B 17/06

[52] U.S. Cl. ..... 428/377; 442/170; 442/178; 139/420 R; 57/224; 57/229

[58] Field of Search ..... 428/377; 57/224, 57/229; 139/420 R; 442/170, 178

[56] References Cited

U.S. PATENT DOCUMENTS

| | | | |
|---|---|---|---|
| 4,304,191 | 12/1981 | David et al. | 428/225 |
| 4,446,191 | 5/1984 | Miyadera et al. | 428/245 |
| 4,528,223 | 7/1985 | Kumazawa et al. | 428/36 |
| 4,684,131 | 8/1987 | Mortvedt | 273/73 |
| 4,770,926 | 9/1988 | Yamamura et al. | 428/224 |
| 5,102,725 | 4/1992 | Knox et al. | 428/245 |
| 5,141,542 | 8/1992 | Fangeat et al. | 57/224 |
| 5,190,802 | 3/1993 | Pilato | 428/111 |
| 5,234,752 | 8/1993 | Laflin et al. | 428/251 |
| 5,424,123 | 6/1995 | Geirhos et al. | 428/357 |
| 5,555,716 | 9/1996 | Dugan | 57/224 |
| 5,641,933 | 6/1997 | Kim | 89/36.02 |
| 5,727,357 | 3/1998 | Arumugasaamy et al. | 52/40.1 |

*Primary Examiner*—Christopher Raimund
*Attorney, Agent, or Firm*—Cort Flint; William D. Lee, Jr.

[57] ABSTRACT

A composite fiber prepared by wrapping a core of polyethylene filaments having a dielectric of less than 3.0 with a direct sized quartz fiber to provide a composite fiber and fabric woven therefrom with improved high temperature strength and low dielectric constant.

20 Claims, 2 Drawing Sheets

LOW DIELECTRIC COMPOSITE FIBER AND FABRIC

FIELD OF THE INVENTION

This invention relates to reinforcing fabrics which are to be coated with thermosetting resins and, in particular, relates to low dielectric fabrics and the fibers from which they are woven to form the substrate for radomes and other shaped, protective structures that have minimum interference with the transmission and reception of electromagnetic signals.

BACKGROUND OF THE INVENTION

The use of fabrics woven from polymeric fibers and fiberglass to reinforce structural members is well known and the use of these materials has proven satisfactory over a number of years. However, in a variety of specialty applications which include protective enclosures for electronic equipment that receives and transmits electromagnetic signals, it is quite important that the protective enclosure interferes with the transmission to only the minimal extent possible. Thus, it is a primary object of the present invention to provide a reinforcing fabric with a low dielectric constant that will be particularly suitable for reinforcing such structures.

Another important factor in developing reinforcing fabrics is to weave the fabric in a manner so that the fabric can be stretched to conform to the desired shape of the article to be formed without wrinkles, bulges, or distortions. Such fabrics are sold under the brand name, "Conform Fabrics®". Conform Fabrics and fabrics of other weave patterns are disclosed in U.S. Pat. No. 5,102,725 which issued on Apr. 7, 1992 to Martha Knox et al and is incorporated herein by reference.

Certain polymeric filaments that can be spun and woven into fabrics have low dielectric constants but tend to soften and weaken when a heated molten thermosetting polymeric material is applied to the fabric as a coating; or, if the coating is applied by immersing the fabric in a bath and then cured by heating at an elevated temperature for an extended period, the curing temperature may be in the range of the glass transition temperature of the polymeric filaments. Thus, it is another object of the present invention to provide a low dielectric fabric with improved strength to withstand the application of heated coatings and curing temperature.

In the past, reinforcing of an aramid fiber by twisting with fiberglass has been proposed as disclosed in U.S. Pat. No. 4,528,223 which issued on Jul. 9, 1985 to Kumazawa et al. However, aramid polymers tend to have a relatively high dielectric constant and tend to absorb moisture which further raises the dielectric constant. Thus, it is yet another object of the present invention to provide a fabric with added strength, lower dielectric constant, and improved bonding to applied coatings than that which can be provided by such prior art fibers and fabrics.

Also, available and useful polyaramid fibers such as those sold under the Kevlar® brand and polyethylene fibers sold under the Spectra® brand must be plasma etched in order to increase the bondability of their surfaces to a satisfactory level. Furthermore, the plasma etching effect has a very limited shelf life, i.e., the surface impregnation and bonding improvement are time dependent so that the fiber and/or fabric so treated must be woven and coated without prolonged delay or storage. Accordingly, it is another object of the present invention to avoid the necessity of plasma etching.

These and other objects of the present invention will become generally apparent to those skilled in the art from the following Summary of the Invention and Detailed Description.

SUMMARY OF THE INVENTION

It has been surprisingly discovered that by selecting a core of polymeric filaments having a dielectric constant of less than or equal to the dielectric constant of quartz fiber and wrapping them with a direct sized quartz fiber that a composite fiber can be produced which has high strength at the curing temperatures of thermosetting coating materials, low dielectric constant, superior bonding properties and does not need to be plasma etched. The composite fiber may be used in weaving a fabric particularly, a reinforcing fabric, or the fibers may be wrapped around a mold to form a reinforcing structure.

It has also been found that a core of polymeric filaments, particularly, high molecular weight polyethylene filaments that have a dielectric constant of about 2.2 or less, when wrapped with a direct sized quartz fiber produce a yarn from which especially suitable reinforcing fabric can be woven. A combined dielectric constant of less than 2.6 can be achieved. While polyethylene is a preferred polymer, the invention includes fibers and filaments of organic carbon based polymers in general.

In one aspect, the present invention is a method of providing a core of filaments which have been selected so that said filaments have a combined or composite dielectric constant of less than about 3.78, the dielectric constant of quartz, and then wrapping the core with a direct sized quartz fiber in a sufficient number of turns per unit length with a gap between turns so that the volume of quartz has not raised the dielectric constant of the resulting composite fiber above about 3.78 yet the desired strength is attained.

In another aspect, the present invention is a fabric woven from the aforementioned composite fiber which is woven in a suitable weave as mentioned herein above. The yarn used in this fabric is also suitable for impregnation for filament winding of composite structures.

In still another aspect, the invention includes a wrapped fiber wherein the wrapping allows a gap so that when a fabric is woven from the fabric and subsequently heated, the polymeric material exposed by the gap will undergo limited flow and melt bond to adjacent polymeric fibers.

In yet another aspect, the present invention is a fabric that can be coated with a thermosetting resin to form a shaped article.

The present invention will be better understood by reference to the Definitions, Description of Drawings, and Detailed Description which follow.

DEFINITIONS

As used herein the following definitions may be referred to by way of explanation of terms but are not limiting on the scope of their meaning:

"Dielectric" has its usual definition of a material that is so weakly conductive that different parts of a sheet of it can hold different electrical charges and generally is considered to have a conductivity of less than $10^{-6}$ siemens per centimeter. In common usage it is often referred to in a relative manner and the "dielectric constant" provides the relative comparison.

"Dielectric constant" is based on a vacuum having a constant of 1.0000 and the ASTM Method as reported in D150 and D1531 is used to determine the constant for material.

"Weave patterns" referred to herein include those that are common to the textile industry. Quite useful patterns are described in the aforementioned patent to Knox et al. In particular, the weaves known as eight harness satin and those of the Conform Fabrics® are preferred.

"Polymer" as used herein, includes homopolymers, copolymers, terpolymers, graph, block and higher polymers. Fibers of the ethylene polymers are particularly suitable. Especially preferred is the extended chain, ultra-high molecular weight polyethylene sold under the brand name Spectra®.

"Polymeric coating" includes thermosetting coating materials which may be applied by spraying, rolling, extruding, or immersion to a reinforcing fabric substrate and include polyesters, transfer molding resins, cyanate esters, and epoxies. For the present invention, in an immersion coating process, the total finished weight of a fabric may have 2% to 60% of the weight represented by coating material which is sometimes also referred to as the "coating resin".

"Sized" and "Direct Sized" refers to surface modification of the fibers. Particularly, the quartz fiber referred to herein, preferably includes the application of a coupling agent which is capable of reacting with both the quartz and the coating resins so that a strong bond can be formed therewith. Generally preferred are the silane coupling agents and the use of these or similar agents is referred to as "direct" sizing.

"Quartz"as used herein and "quartz fiber" mean fibers produced from fused quartz of high purity, namely about 99.95% $SiO_2$ and, because of its purity and amorphous structure, it is distinct in properties and performance from glass, glass fibers, or other silica containing products.

DESCRIPTION OF THE DRAWINGS

The invention will be more readily understood by reference to the accompanying drawings that form a part of this specification and are examples of embodiments of the invention but are not limiting to the scope thereof.

DETAILED DESCRIPTION

Figure 1:
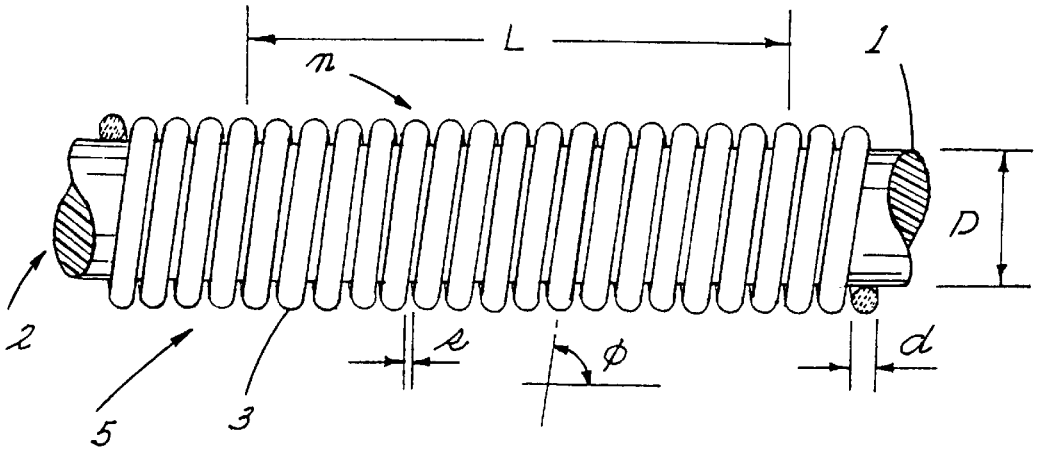
FIG. 1 is a schematic representation of a low dielectric polymeric core wrapped by sized quartz fibers.

Turning now to FIG. 1, core fiber 1 is shown which represents a bundle of polymeric filaments 2 (not shown individually) and these have been selected because they have a dielectric constant of less than about 3.0. Such filaments include those of olefin polymers such as propylene and ethylene. Especially preferred are the extended chain, ultra-high molecular weight polyethylenes sold under the Sprectra® trademark. The linear density, D, of the core preferably ranges from about 1,800 to 30,000 yards per pound and is schematically represented as a diameter in FIG. 1.

The core is wrapped by quartz fiber 3 at a wrap angle $\phi$ which can vary as preferred from as low as a few degrees up to and approaching 90°. The number of turns, "n", per inch, represented by length, "L", can vary from one to about 20 with a preferred range being about 6 to 12. The quartz fiber is direct sized with a coupling agent which preferably is a silane coupling agent which is well known in the art. The fiber linear density, "d", may range from 100 to 5,000 denier. Wrapping is a preferred feature of the invention and is distinguished from a common twist so that the core comprises the major linear volume proportion of the composite fiber. Thus, the gap or spacing "s" will vary according to the denier of the quartz fiber and the turns, "n".

The method of winding the wrap around the core can include such methods as a hand lay-up or wind-up method, or a cabling method. A typical machine for producing such a wrap is a ICBT Cabler which is well known to those skilled in the art. Other suitable processes are also well known to those skilled in the art. After wrapping, the low dielectric composite fiber 5 of the invention is formed.

Figure 2:
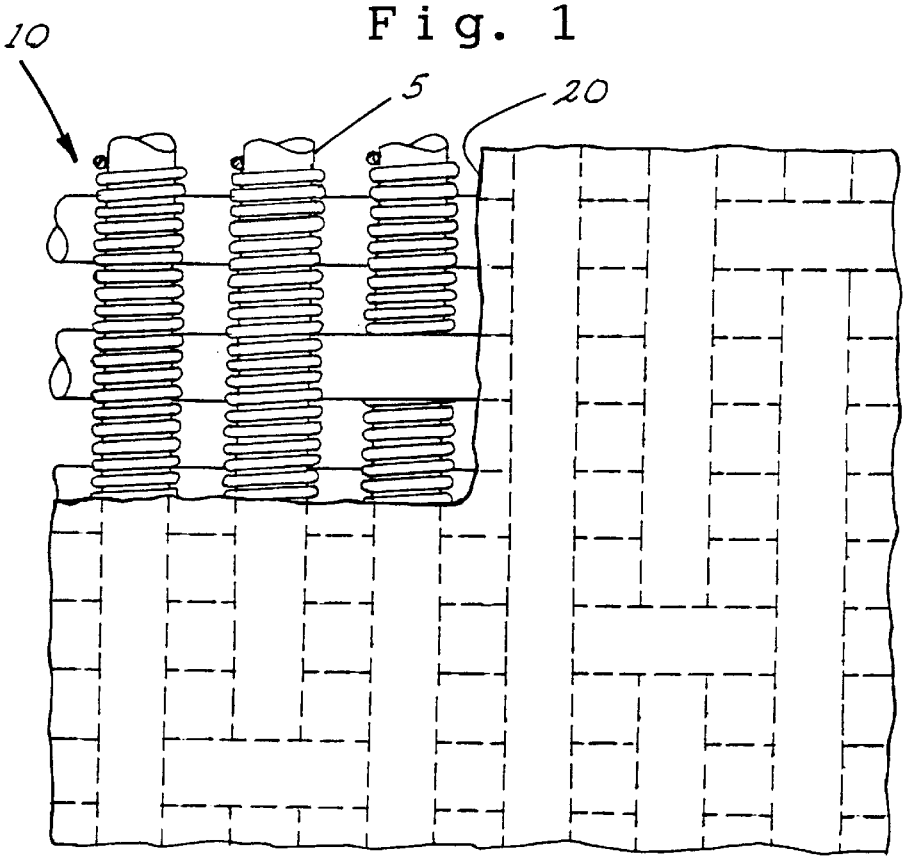
FIG. 2 is a representation of a coated fabric with a breakaway section showing warp yarns that comprise the fiber shown in FIG. 1; and, FIG. 3 is a representation of a coated fabric wherein the sectional breakaway view shows both warp and fill yarns which comprise the fiber of FIG. 1.
Figure 3:
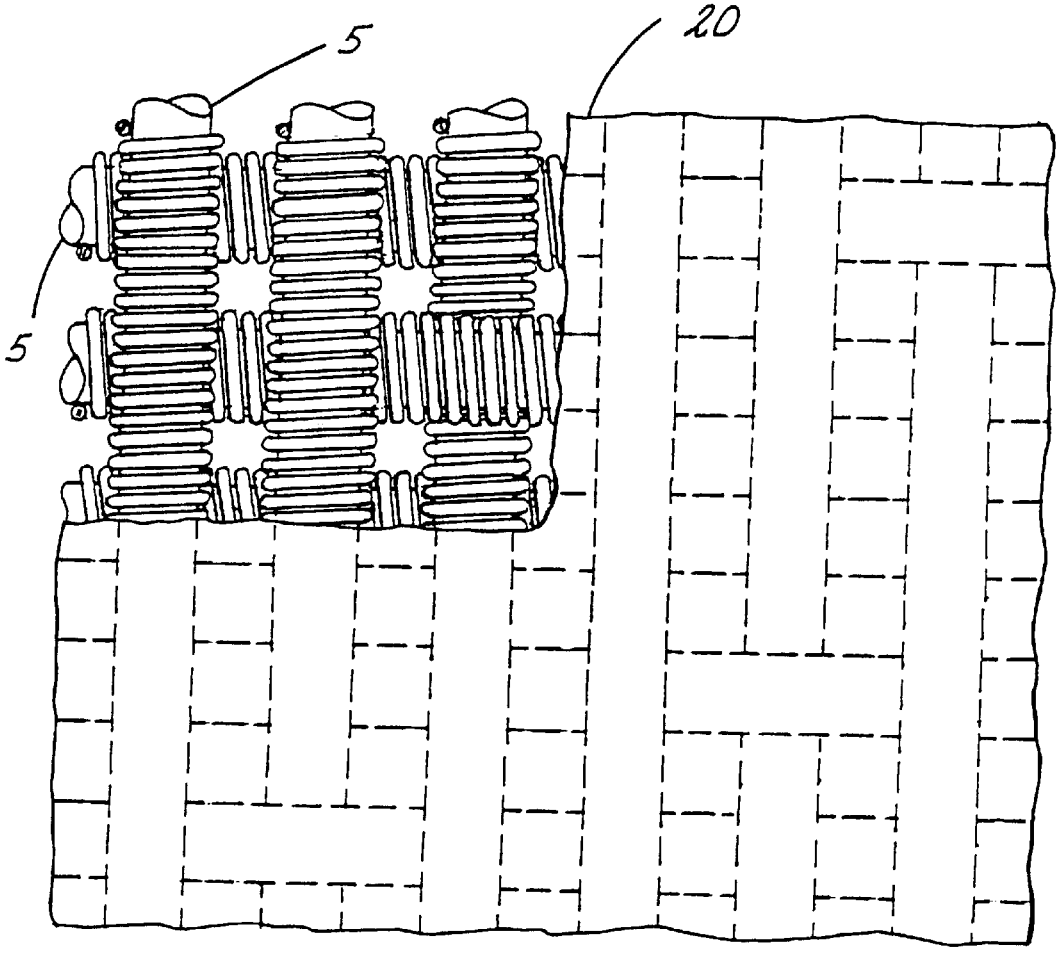

Turning now to FIG. 2, fabric 10 is shown in the breakout section which has been woven with fibers 5 serving as the warp yarn. An eight harness satin fabric weave is preferred. The fabric has been coated with thermosetting polymeric material 20. This polymer may be applied by spraying, hot melt, or by immersing in a coating bath. Thermosetting resins are used as a protective coating and as they cure and "set up" they tend to preserve the shape and dimensional stability of the resulting shaped structure. The important consideration here is that the useful thermosetting resins normally will be cured in the range of 250° F. to 350° F. This temperature is above the glass transition temperature of polymers such as polyethylene so that the strength added by the quartz wrapping of the core fiber is essential. In the preferred process the fabric is dipped or immersed into a coating solution and will pick up a loading of 30% to 40% of its weight from a thermosetting polymers such as cyanate esters or epoxies. The usual curing time runs about two hours. The coating solutions and baths are well known to those skilled in the art.

The particularly preferred core fiber material provided by filaments of the polyethylene sold under the brand name of Spectra® by Allied Chemical Company has a dielectric constant of about 2.2. Quartz fibers can be obtained from QPC, Inc. and these fibers have a dielectric constant of about 3.78.

PREFERRED EMBODIMENT

In a preferred embodiment which is the best mode of the invention, a core fiber of filaments of the Spectra® polyethylene was prepared and wrapped with quartz fiber at 15 turns per inch using an ICBT Cabler. The core fiber unit weight or linear density was about 5,000 yards per pound and the quartz fiber was about 300 denier. The quartz fiber was identified as 300 2/0 from QPC. On a mass per length basis, these units covert to about 0.042 grams of quartz per meter and about 0.102 grams of polyethylene per meter. At the estimated average diameter of the core, 15 turns per inch approximates an additional quartz fiber in each meter so that on a wrapped basis there is a total of 0.084 grams of quartz per meter wrapped onto 0.102 grams of polyethylene. Since the dielectric constant is proportional to volume, the volumes, based on the respective densities, are 0.93 for polyethylene and 2.2 for quartz. The resulting volume per meter is 0.032 $cm^3$ for quartz and 0.109 $cm^3$ for polyethylene. Thus, quartz is 22% and the polyethylene is 78% of this composite. The dielectric constant for quartz is 3.78 and for polyethylene is 2.2; and, on a volume ratio basis, the composite dielectric constant is calculated to be 2.47.

The so prepared fiber is used as the warp and/or fill yarn to weave an eight harness satin fabric which is dipped in a coating bath and then removed after it has picked up about 35% of its weight of cynate ester resin, then solvents are removed by heat, thus producing a reinforced, protective covering material suitable for manufacturing radome covers and similar equipment.

Various resin coating systems can be used with the fabrics of this invention which provide a low dielectric constant and improved strength. Such coated fabrics can be shaped into may different articles where a low dielectric constant is required.

While we have shown and described particular embodiments of the invention, modifications and variations thereof will occur to those skilled in the art and subsequently observe the invention or read this specification. We wish it to be understood therefore that the claims below are intended to cover such modifications and variations which are within the scope and spirit of the invention.

What is claimed is:

1. A low dielectric, composite fiber suitable for weaving into a reinforcing fabric comprising:

a) a core of polymeric filaments having a dielectric constant of less than 3.0;

b) a direct sized quartz fiber wrapped around said core; and, c) said composite having a dielectric constant of less than about 3.0.

2. The composite fiber of claim 1 wherein said polymeric filaments are selected from the group consisting of polyethylene filaments.

3. The composite fiber of claim 2 wherein the filaments are extended chain, ultra-high molecular weight polyethylene.

4. The composite fiber of claim 1 wherein the quartz fiber comprises quartz filaments that are directly sized with a silane coupling agent.

5. The composite fiber of claim 4 wherein said quartz fiber is wrapped between 1.0 and 20.0 turns per inch around said core.

6. The composite fiber of claim 1 wherein said core fiber ranges from 1,800 to 30,000 yards per pound.

7. The composite fiber of claim 5 wherein the quartz fiber ranges from 100 to 5,000 in denier.

8. The composite fiber of claim 1 wherein the dielectric constant is less than about 2.6.

9. A woven fabric comprising warp and/or fill threads of the composite fiber of claim 1.

10. A woven fabric comprising warp and fill threads of the composite fiber of claim 1.

11. The woven fabric of claim 9 wherein said fabric is coated with a polymeric coating material to form a shaped article.

12. The composite fiber of claim 1 wherein the number of turns per inch of the quartz fiber is selected so that the dielectric constant of said composite fiber is below 3.0.

13. The composite fiber of claim 1 wherein the core filaments are polyethylene having a linear density of about 5,000 yards per pound and the core has been wrapped at about 15 turns per inch with a sized quartz fiber of about 375 denier.

14. A low dielectric, reinforcing fabric comprising:

a) warp yarns comprising a core of polymeric filaments having a dielectric constant of less than 3.0, said core being wrapped by direct sized quartz fibers; and, b) fill yarns selected from the group consisting of the yarn of subparagraph a), yarns having cores of ethylene polymers, and yarns having cores of aramid polymers wherein the selected yarns are wrapped with direct sized quartz fibers.

15. The fabric of claim 14 wherein said fabric is woven in a satin weave.

16. The fabric of claim 14 wherein the fabric is woven in a manner such that the fabric can be stretched to conform to a desired shape without wrinkles, bulges or distortions.

17. The fabric of claim 14 wherein the core filaments are selected from the group consisting of ethylene polymers.

18. The fabric of claim 14 including a polymeric coating thereon suitable for forming a shaped article.

19. A method of preparing a low dielectric composite fiber which is suitable for use in weaving a reinforcing fabric comprising the steps of:

a) providing a core fiber of polymeric filaments selected from the group of filaments having a dielectric constant of less than 3.0.; and, b) wrapping said core with a direct sized quartz fiber so that the number of wrapping turns per unit length of core fiber minimizes the gap between turns, but does not raise the resulting dielectric constant of said composite to above 3.0.

20. The method of claim 19 wherein the polymeric filaments comprise extended chain, ultra-high molecular weight polyethylene.

* * * * *